United States Patent [19]

Dunbar

[11] 4,129,899

[45] Dec. 12, 1978

[54] FLASHLIGHT WITH A ROTATABLE LAMP HOLDER

[76] Inventor: George W. Dunbar, P.O. Box 8072, J.F.K. Sta., Boston, Mass. 02108

[21] Appl. No.: 840,020

[22] Filed: Oct. 6, 1977

Related U.S. Application Data

[63] Continuation-in-part of Ser. No. 629,506, Nov. 6, 1975, abandoned.

[51] Int. Cl.[2] ..... F21V 33/00

[52] U.S. Cl. ..... 362/109; 362/199; 362/201

[58] Field of Search ..... 362/109, 119, 120, 197-201

[56] References Cited

U.S. PATENT DOCUMENTS

| | | | |
|---|---|---|---|
| 1,832,563 | 12/1931 | Kuhn | 362/197 |
| 1,893,108 | 1/1933 | Shannon | 362/199 |
| 1,899,868 | 2/1933 | Herlbauer | 362/199 |
| 2,029,861 | 2/1936 | Dabgin | 362/199 |
| 2,254,715 | 9/1941 | Tuller | 362/199 |
| 2,401,366 | 6/1946 | Muldoon | 362/199 |
| 2,586,265 | 2/1952 | Russell | 362/398 |
| 3,103,723 | 9/1963 | Becker | 24/3 F |
| 3,184,589 | 5/1965 | Gibbens | 362/197 |
| 3,519,812 | 7/1970 | Brindley | 362/198 |

*Primary Examiner*—Peter A. Nelson

[57] ABSTRACT

A flashlight has a battery holder provided with battery leads and a lamp holder having lamp socket leads. A connection between the two holders permits the lamp holder to be burned on an axis at right angles to the axis of the lamp socket. The connection may be a shaft carrying the leads of one holder and contacts within the other holder and in engagement with the contacts of its leads or the connection may be externally of both holders with the contacts within it and holding the appropriate contacts in engagement.

12 Claims, 9 Drawing Figures

FLASHLIGHT WITH A ROTATABLE LAMP HOLDER

The present application is a continuation-in-part of Ser. No. 629,506, filed Nov. 6, 1975, and now abandoned.

BACKGROUND REFERENCES

U.S. Pat. No. 2,401,366
U.S. Pat. No. 3,184,589
U.S. Pat. No. 3,519,812

BACKGROUND OF THE INVENTION

The usual flashlight has a lamp holder the position of which is fixed relative to the battery-containing body and while flashlights of that type are excellent for many uses, there are many occasions where adjustment of the light path relative to the body are desirable and sometimes necessry for particular uses. By way of example, the repair of equipment often requires the use of a flashlight and it is frequently found that it is not possible to hold the flashlight in a position where it will illuminate a wanted area thus making service difficult.

Flashlights have been provided of a type that has a lamp holder pivotally connected to the front end of its battery containing body to permit its adjustment through a substantial arc. In addition, flashlights have also been provided with permanent magnets enabling them to be secured in desired positions on surfaces of appropriate materials enabling the user to have both hands free.

THE PRESENT INVENTION

The general objective of the invention is to provide a flashlight having a lamp holder that can be turned on an axis at right angles to that of the lamp socket, desirably through 360° and desirably with reference to a straight ahead position.

In accordance with the invention, this objective is attained with a flashlight the casing of which includes a head portion, a battery receiving portion, a lamp holder, and a rotatable connection between the lamp holder and the head portion of the casing enabling the lamp holder to turn in a fore and aft direction with its optically open end at right angles to the axis of the connection. The casing and lamp holder may be made of any suitable material but are herein described as of a suitable plastic. The battery circuit of the flashlight includes sections in the head portion each of which has a contact. The lamp holder also has sections each having first and second contacts with one first contact connected to the lamp socket and the other engageable by the base contact of a lamp when in the socket and each second contact is in engagement with the appropriate one of the contacts of the sections in the head portion.

Another objective of the invention is to provide such a flashlight with the head portion detachable from the battery receiving portion, an objective attained by providing the head portion with an internal shoulder which secures a disc in a predetermined position when the two casing portions are connected. Each section of the circuit in the head portion has a second contact. The disc has a central contact engageable with the front battery terminal and an outer contact insulated therefrom and completing the switch controlled battery circuit since with the disc between the two portions of the casing, each second contact of the head sections is in engagement with the appropriate disc contact.

Other objectives of the invention are concerned with the rotatable connection between the head portion and the lamp holder with one embodiment of the invention requiring that the lamp holder have a shaft entrant of the head portion and carrying the lamp holder circuit sections with their second contacts in engagement with the second contacts of the head sections of the circuit internally of the head portion.

In another embodiment of the invention the rotatable connection between the head portion and the lamp holder provide for such second contacts engagements externally of the head portion and preferably within the connection which includes two detachably interconnected parts, one carried by the head portion and the other by the lamp holder.

Another objective of the invention is to facilitate and simplify the manufacture and assembly of the flashlights in accordance with the last referred-to embodiment, an objective attained with the second contacts of the lamp holder sections and the contacts of the head portions engageable therewith concentric. Each contact has anchoring tabs shaped and dimensioned to pass through slots in the appropriate one of the parts of the connection with one tab of each contact serving as the appropriate one of the circuit sections. When the parts of the connection are separate from the lamp holder and head portion, the lamp holder and head portions that register with those of the parts thus permit their attachment by means of the anchoring tabs of the contacts.

Other objectives of the invention will be apparent from the specification and the claims.

BRIEF DESCRIPTION OF THE DRAWINGS

A preferred embodiment of a slashlight in accordance with the invention is illustrated by the accompanying drawings and —

THE PREFERRED EMBODIMENT OF THE INVENTION

Figure 1:
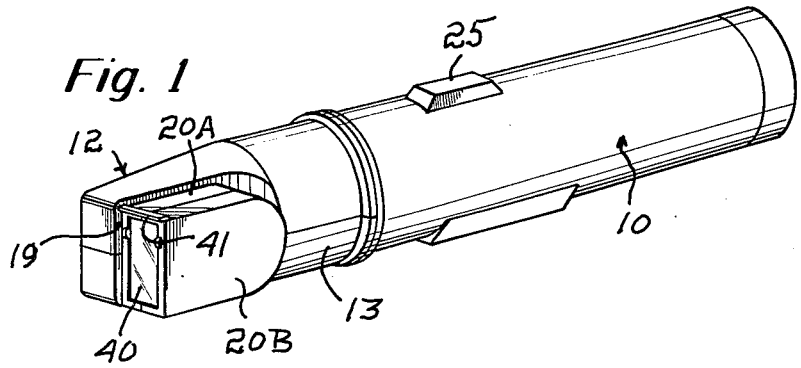
FIG. 1 is a perspective view of such a flashlight.
Figure 2:
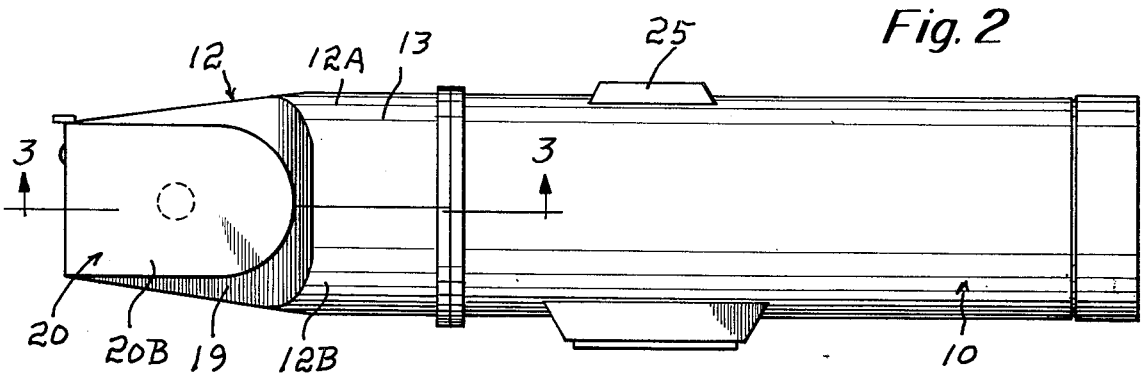
FIG. 2 is a side view thereof on an increase in scale.

The casing of the flashlight shown in the drawings includes a tubular rear section 10 of a suitable plastic closed at its rear end with its other or front end open and provided with threads 11. The casing also includes a head of a suitable plastic, generally indicated at 12, having a cylindrical end portion 13 provided with an internal shoulder 14 and threaded as at 15 to enable it to be threaded on the front end of the rear section 10, then to secure a circular disc contact 16 between the shoulder 14 and the front end of the section 10. A button contact 17 is held centrally of the disc contact 16 by insulation 18.

Figure 3:
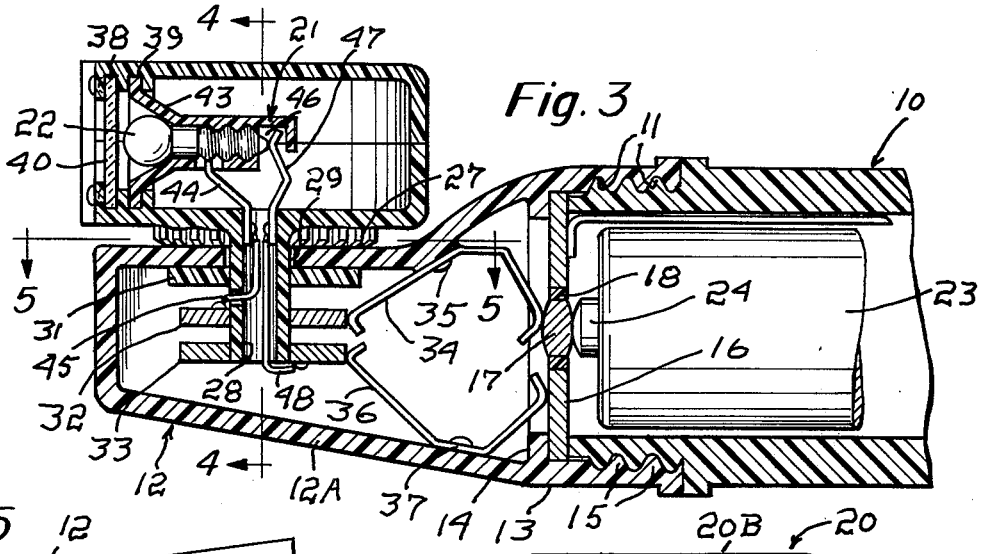
FIG. 3 is a section on a further increase in scale and taken approximately along the indicated line 3—3 of FIG. 2.
Figure 5:
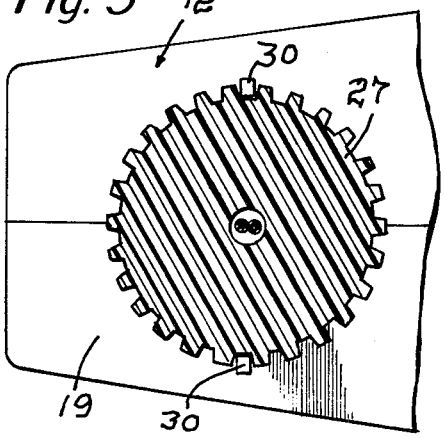
FIG. 5 is a section taken approximately along the indicated line 5—5 of FIG. 3.
Figure 4:
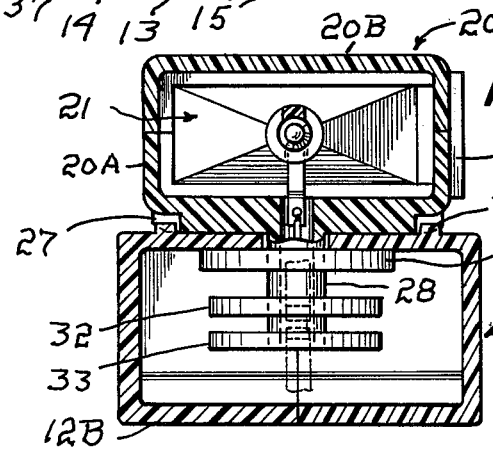
FIG. 4 is a section taken approximately along the indicated line 4—4 of FIG. 3.
Figure 6:
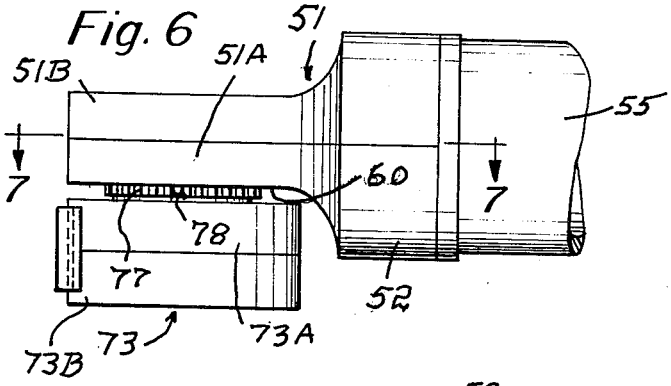
FIG. 6 is a fragmentary view of a flashlight in accordance with another embodiment of the invention.
Figure 7:
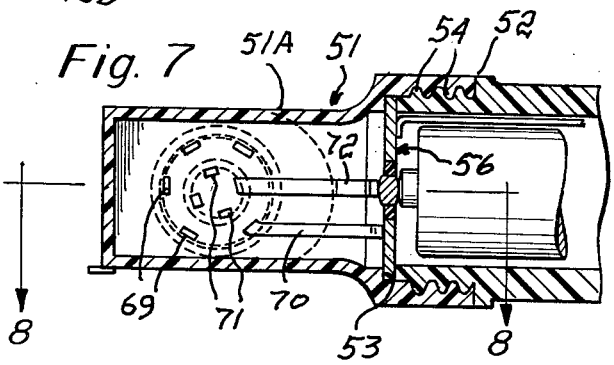
FIG. 7 is a section taken approximately along the indicated line 7—7 of FIG. 6.
Figure 8:
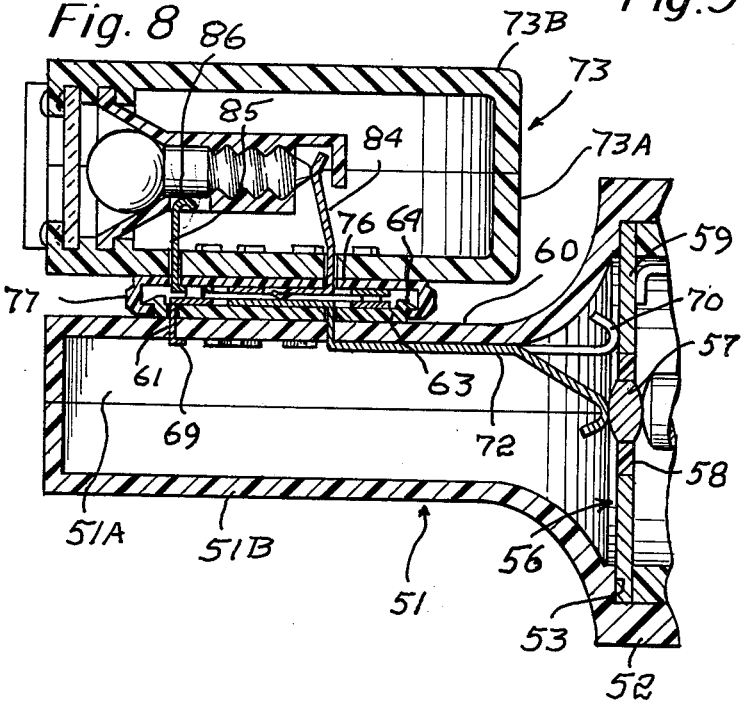
FIG. 8 is a section, on a substantial increase in scale, taken approximately along the indicated line 8—8 of FIG. 7.
Figure 9:
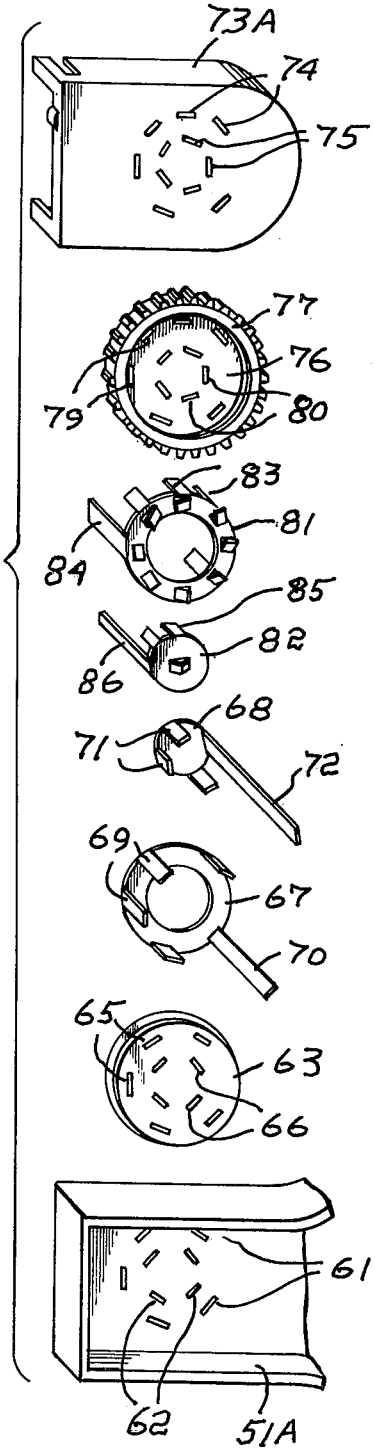
FIG. 9 is an exploded view of the head portion, the lamp holder and the connections therebetween.

The head 12 has a flat side seat 19 and a holder, generally indicated at 20, of a suitable plastic, and having a socket 21 for a lamp 22, the holder 20 rotatably connected through the seat 19 to the head 12 by means presently to be detailed with its axis at right angles to the axis of the casing but with the lamp 22 positioned to direct light in a plane parallel thereto. While the seat 19 is recessed, it will be apparent from FIG. 3 that the plane is externally of the casing but close thereto.

The rear section 10 could be the corresponding part of a conventional flashlight except that the elimination of the usual rear end cap is desired but like such a flashlight, the rear section 10 is shown as dimensioned to receive two batteries in an end-to-end relationship of which one is indicated at 23. Flashlights typically include a spring yieldably urging their batteries forwardly to ensure contact of the front battery terminal 24 with a forward contact or conductor, in the present case, with the button contact 17 and the opposite contact of the rearmost battery engaged by the conductor controlled by the switch, the slide 25 and the conductor 26 of which are shown, the other parts of the battery circuit not shown as they are or may be conventional. When the slide 25 is pushed forwardly to close the battery circuit, the conductor 26 is advanced to engage the disc contact 16.

Turning now to the connction between the holder 20 and the head 12, it will be noted that the holder 20 has flat parallel side walls with the side wall disposed towards the seat 19 formed with an integral gear portion 27 and an axial tubular shaft portion 28 opening into the holder 20 and extending into the head 12 through a port 29 centrally of the seat 19 which is provided with detents 30 engageable with the teeth of the gear portion 27 and, while permitting the head 12 to be turned, yieldably opposing such turning.

The head 12 is formed in two lengthwise sections 12A and 12B joined about the shaft portion 28. A keeper 31 that is a force fit on the shaft portion 28 is seated against the inner surface of the seat 19. A pair of contact discs 32 and 33 are fixed on the shaft portion 28 within the head 12 in an axially spaced relationship. The section 12A has a conductor 34 anchored thereto as at 35 with its ends in engagement with the button contact 17 and the rotatable contact disc 32 and a conductor 36 anchored thereto as at 37 with its ends in engagement with the fixed contact disc 16 and the rotatable contact disc 33.

The holder 20 is also made in two sections, the sections 20A and 20B with the section 20A including both the gear portion 27 and the shaft portion 28. Each holder section has an open end having an outer slot 38 and inner slots 39. The slots 38 and 39 are transversely aligned with the open ends of the slot 38 then exposed to enable a lens member 40 to be entered therein to close the open end of the holder 20. The lens member 40 has a digitally engageable shoulder 41 enabling it to be removed if necessary to replace the lamp 22.

The slots 39 slidably receive the side flanges 42 of the reflector portion 43 of the lamp socket 21. The lamp 22 is threaded into the socket 21 which has a contact 44 in its side wall engageable by the base of the lamp 22 and connected by a lead 45 soldered thereto and extending through the shaft portion 28 and passing through a port therein and welded to the contact disc 32. The lamp socket 21 also has a port 46 exposing the extremity of the base of the lamp and engaged by a contact 47 having a lead 48 soldered thereto and extending through the shaft portion 28 and soldered to the contact disc 33.

While the lamp holder can be turned to direct light from its lamp through 360°, many uses of a flashlight require that it be fixed in a predetermined position. For that reason, the section 10 is encircled by a band 49 that is a friction fit thereon and carries a permanent magnet 50. As the band 49 may be manually turned and also slid axially relative to the casing section 10, adaptability of the flashlight to a wide range of uses when hands-free operation are necessary is ensured. The magnet 50 also serves to prevent the flashlight from rolling.

In the embodiment of the invention illustrated by FIGS. 6–9, the casing is or may be generally similar to that illustrated by FIGS. 1–5 with the head, generally indicated at 51 having its cylindrical end portion 52 provided with an internal shoulder 53 and a thread formation 54 enabling the head 51 to be threaded on the open end of the tubular rear section 55 and then secures the circular disc, generally indicated at 56, between the shoulder 53 and the front end of the section 55. The disc 56 is or may be identical to the disc 16 having a central contact portion 57 insulated as at 58 from the outer contact portion 59. As the rear section 55 is or may be identical to the rear section 10, it is not described.

The head 51 is shown as including molded sections 51A and 51B of a suitable plastic with the section 51A having a seat 60 provided with a first, outer series of slots 61 arranged circularly and a second inner series of similarly arranged slots 62. A plastic disc 63 has an outwardly disposed latching rim 64. The disc 63 has first and second concentric series of slots 65 and 66 spaced and dimensioned so that each slot of each series may register with a respective one of the slots of the appropriate series of slots 61 and 62 when the disc 63 is held against the seat 60. The disc 63 is secured to the seat 60 by contacts 67 and 68, the contact 67 a ring having a series of tabs, one for each slot 65 and dimensioned to pass therethrough and through the appropriate slot 61 in the seat 60 then to be bent against the inner surface thereof, the tabs including short tabs 69 and a long tab 70 disposed in engagement with the disc contact portion 59 thus serving as one of the circuit sections of the head portion 51.

The contact 68 is a disc dimensioned to fit freely within the ring contact 67 and has a series of tabs, one for each slot 66 and dimensioned to pass therethrough and through the appropriate slot 62 in the seat 60 and then to be bent against the inner surface thereof, the tabs of the contact 68 including short tabs 71 and a long tab 72 disposed in engagement with the central contact portion 57 of the disc 56 thus serving as the other circuit section of the head portion 51.

The lamp holder 73 includes sections 73A and 73B molded from a suitable plastic with the section 73A having a concentric series of slots 74 and 75. A plastic disc 76 has a notched and inwardly disposed rim 77 dimensioned to snap over the latching rim 64 of the disc 63 and thus connect the lamp holder 73 to the head 51 so that it may be turned through 360°. The seat 60 is formed with detent lugs 78 in engagement with the rim of the disc 76. The disc 76 has a concentric series of slots 79 and 80 spaced and arranged so that each slot of each series may register with a respective one of the slots 74 and 75.

Before the holder and head are thus joined, the disc 76 is secured to the holder by means of first and second contacts 81 and 82.

The contact 81, like the contact 67, is a ring having a series of tabs, one for each slot 79 and dimensioned to pass therethrough and through the corresponding slot 72 of the holder section 71A and then bent against its inner wall, the series of tabs including short tabs 83 and a long tab 84 engageable with the lamp contact at the end of its base thus to serve as one of the circuit sections of the lamp holder.

The contact 82 is a disc dimensioned to fit freely within the contact 81 and has a series of tabs spaced and dimensioned to pass freely through appropriate slots 79 and 74 and then to be bent back of the holder wall, the series of tabs including short tabs 85 and a longer tab 86 disposed in engagement with the lamp base at 87 thus to serve as the other circuit section of the lamp holder 73.

With this construction the head and holder are easily assembled with the holder free to rotate and with the head and holder contacts maintained in conductive engagement and the holder 73 may be otherwise similar to the holder 20.

I claim:

1. A flashlight including a battery-receiving hollow casing including a head portion and rear portion dimensioned to accommodate at least one battery, a lamp holder having an optically open end and including a lamp socket, and a rotatable connection between said head portion and said holder enabling said holder to turn in a fore and aft direction with said optically open end at right angles to the axis of said connection, said flashlight including a switch controlled battery circuit in which a battery, when within the rear portion, is included and which includes sections in the head portion, each section including a contact, and said lamp holder including a pair of sections each including first and second contacts, the first contacts placing the lamp in the battery circuit when the lamp in said socket and the second contacts are in engagement with the appropriate one of said contacts of said sections as the holder turns, said second lamp socket contacts carried by said rotatable connection.

2. The flashlight of claim 1 and a detachable connection between the head and rear portions of the casing and battery, the circuit includes a second connection detachably clamped between said portions and provided with a pair of contacts, one for each of the first contacts of said sections.

3. The flashlight of claim 1 in which the rotatable connection includes a shaft connecting said holder to said body through said seat and rotatable relative thereto and said shaft includes within the head portion the second pair of lamp socket contacts and leads connecting the appropriate ones of the first and second lamp socket contacts.

4. The flashlight of claim 2 in which the battery circuit includes a switch controlled contact within the rear portion and the second connection is a disc including a central button as a contact engageable with an end battery terminal, an annular portion in engagement with the switch controlled contact, and an intermediate annular insulator separating said button therefrom.

5. The flashlight of claim 3 in which the head portion includes two sections having complemental portions between which the shaft of the holder is clamped when said two sections are united.

6. The flashlight of claim 3 in which the lamp holder includes two sections, one section including said shaft and both sections include at least one channel and the lamp socket includes a flange entrant of said channels and held thereby when the two holder sections are united.

7. The flashlight of claim 6 in which the two holder sections include a second channel between the first named channel and the open end of the holder, and the second channel, when the holder sections are united, define an open-ended slideway and a lens is removably confined therein.

8. The flashlight of claim 1 in which the connections include a member on the head portion establishing the axis of rotation and within which the second contacts of the sections are exposed, one spaced from the other, a member on the lamp holder within which the second contacts of the lamp socket are exposed, and means interconnecting said member and permitting the members to turn, one relative to the other, the second contacts of the lamp socket each spaced and arranged then to be held against the appropriate one of the second contacts of the sections as the lamp holder is turned on its axis.

9. The flashlight of claim 7 in which both members of the connection have inner and outer circular series of slots, those of one member opening into the head portion and those of the other member opening into the lamp holder, and a pair of contacts, one for each series of slots, each contact including a series of tabs dimensioned to pass through the slots of a particular one of the slot series, one tab establishing the appropriate one of the circuit section, and the other tabs anchoring tabs, corresponding ones of the contacts of the head portion section and holder section held in engagement.

10. The flashlight of claim 8 in which the members are separate parts and both the head portion and the lamp holder have circular series of slots to register with those of said members and the tabs extend therethrough.

11. The flashlight of claim 9 in which the contacts for both outer series of slots are rings and the other contacts are discs dimensioned to fit freely therein.

12. The flashlight of claim 9 in which the members have portions engageable as snap fits, one within the other.

* * * * *